US005629141A

United States Patent [19]

Kawamoto

[11] Patent Number: 5,629,141

[45] Date of Patent: May 13, 1997

[54] PROCESS FOR HEAT TREATMENT OF A PHOTOGRAPHIC SUPPORT

[75] Inventor: Fumio Kawamoto, Minami-ashigara, Japan

[73] Assignee: Fuji Photo Film Co., Ltd., Minami-ashigara, Japan

[21] Appl. No.: 558,539

[22] Filed: Nov. 16, 1995

[30] Foreign Application Priority Data

Nov. 22, 1994 [JP] Japan ..... 6-287757

[51] Int. Cl.[6] ..... G03C 1/795

[52] U.S. Cl. ..... 430/495.1; 430/501; 430/533; 430/930; 430/935; 430/939; 264/234

[58] Field of Search ..... 430/495.1, 501, 430/533, 930, 935, 939; 264/234, 235, 284, 345, 346

[56] References Cited

U.S. PATENT DOCUMENTS

| | | | |
|---|---|---|---|
| 4,141,735 | 2/1979 | Schrader et al. | 428/913 |
| 5,254,445 | 10/1993 | Takamuki et al. | 430/530 |
| 5,294,473 | 3/1994 | Kawamoto | 430/523 |
| 5,310,635 | 5/1994 | Szajewski | 430/501 |
| 5,462,824 | 10/1995 | Kawamoto et al. | 430/533 |

FOREIGN PATENT DOCUMENTS

| | | | |
|---|---|---|---|
| 0606070 | 7/1994 | European Pat. Off. | 430/533 |
| 5825 | 1/1989 | Japan . | |
| 2280141 | 11/1990 | Japan | 430/533 |
| 51155 | 3/1993 | Japan . | |

*Primary Examiner*—Lee C. Wright

*Attorney, Agent, or Firm*—Burns, Doane, Swecker & Mathis, LLP

[57] ABSTRACT

There is disclosed a process for heat treatment of a photographic polyester film support, comprising steps of winding a biaxially oriented polyester film into a roll so that the thickness of a gas layer lying between the film layers continually becomes 1.5 μm to 10 μm, and then subjecting the roll of the polyester film to heat treatment at a temperature between 50° C. and the glass transition temperature of the polyester. According to the above process, a photographic polyester film support, which is excellent in flatness of the film and does not cause unevenness of coating, can be provided.

13 Claims, No Drawings

PROCESS FOR HEAT TREATMENT OF A PHOTOGRAPHIC SUPPORT

FIELD OF THE INVENTION

The present invention relates to a process for heat treatment of a photographic polyester support, whereby the support has a minimized core set curl caused by heat treatment, the flatness of the film is not deteriorated, and unevenness of the coating is not caused when photographic emulsions are subjected to a multi-layered simultaneous coating.

BACKGROUND OF THE INVENTION

Polyester films have been considered to be more advantageously used in place of TAC film because they have excellent productivity, mechanical strength, and dimensional stability. Despite the above-described excellent properties, however, when polyester films are used for a roll film, they have the drawback of a poor handling property after development processing, due to a persistently remaining core set curl in the form of roll that is used for various types of photographic light-sensitive materials. Therefore, that is problem for using polyester films in the form of roll. U.S. Pat. No. 4,141,735 describes that heating of the polyester film improves the core set curl. However, it is difficult to practically use such the method, because when a bulky roll is simply subjected to heat treatment on an industrial scale, tightness of the roll, distortion, and rumples are caused, which results in a coating unevenness when photographic emulsions are subjected to a multi-layered simultaneous coating. JP-A ("JP-A" means unexamined published Japanese patent application) No. 51155/1993 describes a technique that comprises steps of winding a film into a roll so that the thickness of a gas layer lying between the film layers becomes 0.1 to 0.7 μm, and then subjecting the roll of the film to heat treatment.

SUMMARY OF THE INVENTION

Accordingly, an object of the present invention is to provide a process for heat treatment of a polyester support, whereby the support has a minimized core set curl caused by heat treatment, the flatness of the film is excellent, and unevenness of the coating is not caused.

Other and further objects, features, and advantages of the invention will appear more fully from the following description.

DETAILED DESCRIPTION OF THE INVENTION

The object of the present invention has been attained by a process that comprises steps of winding a biaxially oriented polyester film into a roll so that the thickness of a gas layer lying between the film layers continually becomes 1.5 μm to 10 μm, and then subjecting the roll of the polyester film to heat treatment at a temperature between 50° C. and the glass transition temperature (Tg) of the polyester.

Deterioration of the flatness of the support that is caused by heat treatment of the support results from stress related heat contraction and heat expansion. This stress is difficult to remove from a roll, so that the support is stretched, and the flatness thereof is apt to be lowered.

In order to resolve this problem, it is most effective to remove the stress. Such stress is generated when the support cannot move to contract or expand because sliding between support layers of the roll is difficult.

Further, in order to remove stress generated during heat treatment, an effective method is to increase the amount of air lying between the support layers of the roll. The preferred thickness of the air layer is from 1.5 μm to 10 μm, more preferably from 2 μm to 8 μm, and particularly preferably from 2.5 μm to 5 μm. Herein, adjacent support film layers may contact in part to each layer and the above thickness of a gas layer is "an average thickness" of thickness of a gas layer lying between the film layers. Further, the thickness of a gas layer is described below:

A Thickness of the Air Layer Lying Between the Support Layers

The radius of the roll in advance of heat treatment is measured at five points in the width (the roll is divided into seven equal parts in the direction of the width, and the two end points are neglected, to retain five points). An average value R (mm) of these radii is calculated.

The radius r (mm) of a core of the roll, the thickness T (μm) of the support, and the length of the support L (m) are measured, and then the thickness A (μm) of the air layer lying between the support layers is calculated according to the following formula:

$$A=\{(\pi/L)\times(R^2-r^2)\}-T$$

On the other hand, the flatness is improved as the air layer becomes thicker, whereas shear in winding easily occurs when the air layer is too thick. In order to prevent the shear in winding, it is preferred to provide a rollette (knurling) at the both ends for the width of the support (both right and left ends towards the direction of rolling). Without a rollette, shear in winding occurs in rolling when the air layer is only about 3 μm. However, the shear in winding can be prevented while maintaining a sufficient thickness of the air layer by providing the rollette at the ends of the support, according to the present invention. In other words, the shear in winding between the support layers can be prevented by forming a proper air layer by means of the rollette, which is able to leave a space between the support layers, and at the same time by engaging convexity and concavity of the toilette. When the supports are provided with a rollette, the preferred thickness of the air layer is not more than 10 μm, more preferably not more than 8 μm, and particularly preferably 6 μm or less.

Provision of such a rollette (knurling) can be attained by using a method in which a pair of upper and lower side rollers (pressed rollers) have convexity and concavity as mentioned above. The prepared height of the rollette is from 1 μm to 50 μm, more preferably from 2 μm to 30 μm, and particularly preferably from 3 μm to 25 μm. The thickness of the knurled portion in rolled support (the height of rollette (knurling)) is preferably thicker (larger) by 5 to 50 μm than the average thikckess of the support. When the rollette is too high, winding easily becomes unstable, which results in the occurrence of shear in winding. On the other hand, when the rollette is too low, a sufficient air layer cannot be formed, and therefore improvement of the flatness cannot be attained. The preferred width of the rollette is from 2 mm to 50 mm, more preferably from 5 mm to 30 mm, and particularly preferably 7 mm to 20 mm. When the rollette is shorter than the above-mentioned width, it is difficult to obtain a sufficient effect of preventing shear in winding. On the other hand, a rollette that is longer than the above-mentioned width is not preferred, since yield of product (obtainment) of the support is lowered. These may be one side or both side-pressed rollettes. Further, it is preferred to provide the support with a rollette at a temperature not lower than the support's Tg. A low temperature at the provision of the rollette is not preferable, since the toilette is easily crushed during heat treatment.

Further, the thickness of the air layer between the supports can also be controlled by adjusting the condition of winding. The most important condition is the winding tension. A preferred tension is from 3 to 75 kg/m, more preferably from 5 to 40 kg/m, and particularly preferably from 10 to 35 kg/m. When the winding tension is too strong, the thickness of the air layer between the support layers becomes thinner, so that it is difficult to remove the stress generated during heat treatment, and also self-adhesion of the supports easily occurs. On the other hand, when the tension is too weak, the thickness of the air layer becomes too thick. Therefore unpreferable shear in winding is apt to occur during handling. Accordingly, the winding tension is preferably from 3 to 75 kg/m, more preferably from 5 to 40 kg/m, and particularly preferably from 10 to 35 kg/m. The winding may be conducted at a constant tension, or while gradually increasing or decreasing the tension. A preferred method is to conduct the winding while decreasing the tension.

Further, the thickness of the air layer can also be controlled by the winding speed. The preferred winding speed is from 5 m/min to 150 m/min, more preferably from 10 m/min to 100 m/min, and particularly preferably from 20 m/min to 80 m/min. At a higher speed than the above-described range, a large amount of air is rolled in during the winding, so that the thickness of the air layer is apt to become larger. On the other hand, at a lower speed than the above-described range, the air layer easily become thinner and it is unpreferable. Otherwise, the thickness of the air layer can also be controlled by a method described in JP-A No. 51155/1993.

Moreover, the diameter of the reel for winding the support is preferably from 100 mm to 1,500 mm, more preferably from 150 mm to 1,000 mm, and further preferably from 200 mm to 800 mm. When the diameter is larger than the above range, handling, such as transportation, becomes difficult. On the other hand, when the diameter is shorter than the above range, the number of times for winding the support increases, so that heat contraction stress, which the support near the reel receives, is apt to become high and deterioration of the flatness is easily caused. The quality of the material for a roll reel is not limited. However, preferably the materials are not reduced in strength or modified due to heat. Examples of such materials are stainless steel, aluminum, and a resin containing a glass fiber. Optionally, gum and resins may be coated on the reel. Further, these roll reels may have a hollow structure, in order to increase the efficiency of the transmission of temperature to a film, or alternatively they may have an electric heater built-in for heating, or a structure in which a hot liquid can be flowed.

As to the environment for conducting in winding, the winding may be conducted at any temperature ranging from room temperature to the Tg of the support. However, it is necessary to pay attention to humidity. The preferred relative humidity is from 0% to 85%, more preferably from 0% to 80%, and furthermore preferably from 0% to 75%. At a higher humidity than the above-described range, self-adhesion occurs.

The heat treatment is conducted at a temperature of the Tg or lower. The preferred temperature for use in heat treatment is 50° C. or more, but less than the Tg; more preferably (the Tg−25° C.) or more, but less than the Tg; and particularly preferably (the Tg−15° C.) or more, but less than the Tg.

With respect to polyethylene-2,6-naphthalate, the Tg thereof is 120° C., and the preferred heat treatment temperature is from 95° C. to 120° C., more preferably from 100° C. to 115° C., and furthermore preferably from 105° C. to 115° C.

Further, it is also an effective method to increase a migrating amount of an air lying between support layers inside of the roll, in order to remove the stress that generates during heat treatment. It is a general method to incorporate a lubricant (organic or inorganic fine particles) into a support as a paste. However, in order to attain sufficient lubricity according to this method, a large amount of the lubricant is necessary, which results in increased haze. Therefore, it is not preferred to apply this method to a photographic support that must have high transparency. Accordingly, it is preferred to coat a lubricant on a surface of the support in the present invention. This can be attained by one of the following two methods. One method is to physically or chemically cut a surface, to make convexity and concavity. Specific examples are a method in which a surface is physically treated by rubbing the surface with a roll whose surface has convexity and concavity, and a method in which a surface is chemically treated by coating, on the surface, an etching solvent (phenol-type solvents and halogen-type solvents for polyester). These methods, however, have the problems that difficulty is caused by powders produced by rubbing, and that it is difficult to control the convexity and the concavity.

Another method is to coat fine particles on the support. This method is more preferred, because the above-mentioned problems do not occur. The diameter of the fine particles used in the present invention is preferably no greater than 20 μm, and more preferably no greater than 10 μm.

Ordinary organic or inorganic fine particles can be used as such fine particles.

Example inorganic fine particles that can be used are oxides, hydroxides, sulfides, nitrides, halides, carbonates, acetates, phosphates, phosphites, organic carbonates, silicates, titanates, borates of IA group, IIA group, IVA group, VIA group, VIIA group, VIIIA group, IB group, IIB group, IIIB group, or IVB group elements; and hydrates of all these; complex compounds composed of these compounds as a main ingredient; and natural mineral particles. Specific examples include IA group element compounds, such as lithium fluoride and borax (sodium borate·hydrate); IIA group element compounds, such as magnesium carbonate, magnesium phosphate, magnesium oxide (magnesia), magnesium chloride, magnesium acetate, magnesium fluoride, magnesium titanate, magnesium silicate, magnesium silicate·hydrate (talc), calcium carbonate, calcium phosphate, calcium phosphite, calcium sulfate (gypsum), calcium acetate, calcium telephthalate, calcium hydride, calcium silicate, calcium fluoride, calcium titanate, strontium titanate, barium carbonate, barium phosphate, barium sulfate, and barium phosphite; IVA group element compounds, such as titanium dioxide (titania), titanium monoxide, titanium nitride, zirconium dioxide (zirconia), and zirconium monoxide; VIA group element compounds, such as molybdenum dioxide, molybdenum trioxide, and molybdenum sulfide; VIIA group element compounds, such as manganese chloride and manganese acetate; VIII group element compounds, such as cobalt chloride and cobalt acetate; IB group element compounds, such as cuprous iodide; IIB group element compounds, such as zinc oxide and zinc acetate; IIIB group element compounds, such as aluminum oxide (alumina), aluminum fluoride, and alumino silicate (almina silicate, kaolin, kaolinite); IVB group element compounds, such as silicon oxide (silica, silica gel), cliftnite, carbon, graphite, and glass; and natural mineral particles, such as carnallite, kainite, mica (mica, phlogopite), and pyroaurite.

Preferable organic fine particles are high-molecular compounds having a glass transition temperature of not lower than 50° C., more preferably not lower than 90° C., and particular preferably not lower than 95° C.

Specific examples of the high-molecular compounds that compose the organic fine particles are polytetrafluoroethylene, cellulose acetate, polystyrene, polymethyl methacrylate, polypropyl methacrylate, polymethyl acrylate, polyethylenecarbonate, starch, and powdered mixtures of these polymers.

Further, use can be made of high-molecular-weight compounds synthesized by suspension polymerization, as well as spherical high-molecular-weight compounds or inorganic compound formed by a spray dry method or a dispersion method.

Furthermore, high-molecular compounds that are prepared by polymerizing one kind, or two or more kinds, of monomer compounds, as described below, may be processed by various methods, to obtain fine particles. Preferred examples of the monomer compound to be used are acrylic acid esters, methacrylic acid esters, vinyl esters, styrenes, and olefins.

Further, fine particles containing a fluorine atom or a silicon atom may be used in the present invention. Examples of these fine particles having a preferred composition are polystyrene, polymethyl (meth)acrylate, polyethyl acrylate, poly(methyl methacrylate/methacrylic acid=95/5 (molar ratio)), poly(styrene/styrenesulonic acid=95/5 (molar ratio)), polyacrylonitrile, poly(methyl methacrylate/ethyl acrlate/methacric acid=50/40/10), and silica.

It is more preferable to use electrically conductive fine particles in addition to these organic or inorganic fine particles. An effect of these electric conductive fine particles is particularly marked when a surface-treated support is subjected to heat treatment.

The surface treatment is conducted in order to improve adhesion between a fine particle layer and a support, so that exfoliation of the fine particles during the heat treatment can be prevented. However, the surface-treated support is electrified in many occasions, and the electrification accelerates self-adhesion (blocking) between the support layers during the heat treatment. Static electricity can be eliminated by forming a crack-preventing layer with electric conductive particles, and as a result, the occurrence of self-adhesion can be controlled.

Further, these electric conductive particles also exhibit an effect to prevent dust collection due to static electricity. When the heat treatment is conducted under a condition in which debris and dust are rolled in a roll of polyester film, the unevenness caused by these materials is transferred, extending through several rounds (layers), which eventually leads to a decrease in the flatness. Accordingly, the electric conductive particles are effective in preventing this problem and in attaining a high degree of flatness.

It is preferred to coat such an electric conductive layer so that resistance thereof becomes in the range of from $10^3\Omega$ to $10^{12}\Omega$, more preferably from $10^4\Omega$ to $10^{11}\Omega$, and particularly preferably from $10^5\Omega$ to $10^{10}\Omega$. When resistance is over the above-described range, sufficient effects are hardly obtained. On the other hand, when resistance is below the range, an excessive amount of antistatic agent is necessary, which results in the occurrence of haze and coloring.

Examples of these electrically conductive fine particles include metal oxides and ionic compounds. The electrically conductive fine particles that are preferably used in the present invention are electrically conductive metal oxides and their derivatives, electrically conductive metals, carbon fibers, and π-conjugated system high molecular compounds (e.g., polyarylene vinylene), with inorganic fine particles comprising crystalline metal oxide being particularly preferred among the above electrically conductive materials.

The volume resistivity of these electrically conductive inorganic fine particles is preferably not more than $10^7$ Ωcm, more preferably not more than $10^6$ Ωcm, and furthermore preferably not more than $10^5$ Ωcm. When the volume resitivity is higher than the above-described range, a sufficient antistatic property cannot be obtained.

Most preferably electrically conductive inorganic particles are fine particles of crystalline metal oxide of at least one selected from among ZnO, $TiO_2$, $SnO_2$, $Al_2O_3$, $In_2O_3$, $SiO_2$, MgO, BaO, $MoO_3$, and $V_2O_5$, or these complex oxides. Among these, the particularly preferable compounds are electrically conductive materials whose main component is $SnO_2$, while about 5 to 20% of antimony oxide and/or further other component (e.g., silicon oxide, boron, and phosphorus) may be contained.

Further, ionic electric conductive polymers or latexes may also be used. The kind of the ionic electric conductive polymers to be used is not particularly limited, and they may be anionic, cationic, betain, or nonion. Preferably these materials are anionic or cationic ones. More preferred materials are sulfonic acid-, carboxylic acid-, or phosphoric acid-containing anionic polymers or latexes, as well as tertiary amine-, quaternary ammonium-, or phosphonium-containing materials.

Two or more of these organic or inorganic electric conductive or non-electric conductive fine particles may be used as a mixture. Preferably these fine particles are electric conductive or non-electric conductive inorganic fine particles and electric conductive organic fine particles, and most preferably they are electric conductive inorganic fine particles.

With respect to the size of fine particles in which primary particles aggregate to form secondary particles, as electric conductive inorganic fine particles, the size of the primary particles is preferably from 0.0001 to 1 μm, more preferably from 0.001 to 0.5 μm, and particularly preferably from 0.001 to 0.3 μm. The size of the secondary particles is preferably from 0.01 to 5 μm, more preferably from 0.02 to 3 μm, and particularly from 0.03 to 2 μm.

Further, the size of fine particles comprising homogeneous particles other than these is preferably from 0.01 μm to 5 μm, more preferably from 0.02 μm to 3 μm, and particularly preferably from 0.03 μm to 2 μm.

These non-electric conductive or electric conductive organic or inorganic fine particles may be coated with a coating solution containing them, but free from a binder. In this embodiment, a preferred coating amount of the particles is from 0.005 g/m$^2$ to 3 g/m$^2$, more preferably from 0.01 g/m$^2$ to 1.5 g/m$^2$, and particularly preferably from 0.02 g/m$^2$ to 1.0 g/m$^2$. It is preferred to coat a binder on the particle layer.

Further, it is more preferred to coat these non-electric conductive or electric conductive fine particles with a binder. In this embodiment, a preferred coating amount of the particles is from 0.001 g/m$^2$ to 3 g/m$^2$, more preferably from 0.001 g/m$^2$ to 1.0 g/m$^2$, furthermore preferably from 0.005 g/m$^2$ to 0.5 g/m$^2$, and particularly preferably from 0.01 g/m$^2$ to 0.3 g/m$^2$. A coating amount of the binder is preferably from 0.001 g/m$^2$ to 2 g/m$^2$, more preferably from 0.005 g/m$^2$ to 1 g/m$^2$, and particularly preferably from 0.01

$g/m^2$ to 0.5 $g/m^2$. At this time, the weight ratio of the fine particles to the binder is preferably from 1000/1 to 1/1000, more preferably from 500/1 to 1/500, and particularly preferably from 250/1 to 1/250. Further, these fine particles to be used may be a mixture of spherical particles and fibriform particles.

Example binders for use are known thermalplastic resins, thermal-setting resins, radiation-setting resins, reactive resins, and a mixture thereof, and hydrophilic binders, such as gelatin.

Examples of the thermal plastic resin include cellulose derivatives, such as cellulose triacetate, cellulose diacetate, cellulose acetate maleate, cellulose acetate phthalate, hydroxyacetylcellulose phthalate, cellulose straight-chain alkyl ester, nitrocellulose, cellulose acetate propionate, cellulose acetate butylate resin; vinyl copolymers, such as vinyl chloride/vinyl acetate copolymer, vinyl chloride or vinyl acetate/vinyl alcohol, maleic acid and/or acrylic acid copolymer, vinyl chloride/vinylidene chloride copolymer, vinyl chloride/acrylonitrile copolymer, and ethylene/vinyl acetate copolymer; acrylic acid resins, polyvinyl acetal resins, polyvinyl butyrol resins, polyester polyurethane resins, polyether polyurethane resins, polycarbonate polyurethane resins, polyester resins, polyether resins, polyamide resins, amino resins; gum resins, such as stylene/butadiene resins and butadiene/acrylonitryl resins; silicone resins, and fluoric resins.

Radiation-setting resins for use may be those in which a group having a carbon-carbon unsaturated bond as a functional group for the radiation- setting is connected to the above-described thermal plastic resin. Preferable examples of such a functional group are an acryloyl group and a methacryloyl group.

To the above-described binded molecules, a polar gruop may be introduced (an epoxy group, $CO_2M$, OH, $NR_2$, $NR_3X$, $SO_3M$, $OSO_3M$, $PO_3M_2$, $OPO_3M_2$, wherein M represents a hydrogen atom, an alkali metal, or an ammonium group; and when there are two or more M's in a group, they may be different from each other; and R represents a hydrogen atom or an alkyl group).

The above-illustrated high-molecular binders may be used singly or in a mixture thereof. They can be used for a setting treatment with a known bridging agent of isocyanate type, and/or a radiation-setting vinyl monomer.

Further, examples of the hydrophilic binder include a water-soluble polymer, a cellulose ester, and a latex polymer. Examples of the water-soluble polymer include gelatin, gelatin derivatives, casein, agar-agar, sodium alginate, starch, polyvinyl alcohol, polyacrylic acid copolymer, and maleic acid anhydride copolymer. Examples of the cellulose ester are carboxymethyl cellulose and hydroxyethyl cellulose. Examples of the latex polymer are vinyl chloride-containing copolymer, anhydrous vinylidene-containing copolymer, acrylic acid ester-containing copolymer, vinyl acetate-containing copolymer, and butadien-containing copolymer. Gelatin is most preferred among these polymers. Further, another hydrophilic binder, such as gelatin derivatives, may be used with gelatin.

A gelatin-containing layer may be hardened with a hardening agent. Example hardening agents that may be used are aldehyde compounds, such as formaldehyde and glutaraldehyde; ketone compounds, such as diacetyl and cyclopentanediene; bis(2-chloroethylurea), 2-hydroxy-4,6-dichloro-1,3,5-triazine, and other reactive halogen-containing compounds; divinylsulfone, 5-acetyl-1,3-diacryloylhexahydro-1,3,5-triazine, and other reactive olefin-containing compounds; N-hydroxymethylphthalimide, N-methylol compound, isocyanate compounds, aziridine compounds, acid derivatives, epoxy compounds, and halogen carboxy aldehydes, such as mucochloric acid. Further, example inorganic hardening agents are chrome alum and zirconium sulfate. And additionally, active carboxyl group-containing hardening agents can be used.

These fine particles used in the present invention can be coated on a support by any one of generally well-known methods, such as a dip coating, an air-knife coating, a curtain coating, a roller coating, a wirebar coating, a gravure coating, a slide coating, and an extrusion coating using a hopper, as described in the specification of U.S. Pat. No. 2,681,294. Furthermore, according to circumstances, multilayers can be simultaneously coated by a method as described, for example, in the specifications of U.S. Pat. Nos. 2,761,791, 3,508,947, 2,941,898, and 3,526,528, and in Yuji Harasaki, *Coating Technology* (Coating Kogaku) p. 253 (edited by Asakura Shoten, 1973).

Preferred among monomers of a dicarboxylic acid unit constituting a polyester support according to the present invention, are naphthalene dicarboxylic acids (e.g., 2,6-, 1,5-, 1,4-, and 2,7-), terephthalic acid (TPA), isophthalic acid (IPA), orthophthalic acid (OPA), and paraphenylenedicarboxylic acid (PPDC), with 2,6-naphthalenedicarboxylic acid (2,6-NDCA) being more preferable.

Preferably the content of naphthalenedicarbxylic acid contained in all dicarboxylic acid residual groups is not less than 30 mol %, more preferably 50 mol % or more, and furthermore preferably 70 mol % or more.

Among the thus polyesters, the polyester whose intrinsic viscosity measured at 35° C. in a solvent ortho-chlorophenol is 0.40 or more, but 0.9 or less, more preferably from 0.45 to 0.70 is preferable.

Among these polyesters, the polyester whose glass transition temperature (Tg) is 90° C. or higher, but 200° C. or lower, more preferably 95° C. or higher, but 190° C. or lower, and further preferably 100° C. or higher, but 180° C. or lower is preferable. The most excellent polymer is polyethylene 2,6-naphthalene dicarboxylate (PEN).

Further, to these polyesters, other polyesters can be blended in some portion (to obtain a blend of polymers), in addition to use the homopolymers or copolymers alone. The blend of polymers can be easily prepared according to the methods described in JP-A Nos. 5482/1974, 4325/1989, and 192718/1991; Research Disclosure No. 283, pp 739–741; ibid No. 284, pp 779–782; and ibid No. 294, pp 807–814.

Preferable specific examples of polyester that can be used in the present invention are mentioned below, which, however, are not intended to restrict the scope of the present invention.

Examples of Polyester Homopolymers

| | | |
|---|---|---|
| P-1: | Polyethylene Naphthalate (PEN) [2,6-Naphthalene dicarboxylic acid (NDCA)/Ethylene glycol (EG) (100/100)] (PEN) | Tg = 120° C. |

Examples of Polyester Copolymers

| (the figures in parenthesis indicate a molar ratio) | | |
|---|---|---|
| P-2: | 2,6-NDCA/TPA/EG (65/35/100) | Tg = 96° C. |
| P-3: | 2,6-NDCA/TPA/EG (75/25/100) | Tg = 102° C. |
| P-4: | 2,6-NDCA/TPA/EG/BPA (bisphenol A) (50/50/75/25) | Tg = 112° C. |
| P-5: | 2,6-NDCA/EG/BPA (100/50/50) | Tg = 155° C. |
| P-6: | 2,6-NDCA/EG/BPA (200/25/75) | Tg = 155° C. |
| P-7: | 2,6-NDCA/EG/CHDM (cyclohexanedimethanol)/BPA (100/25/25/50) | Tg = 150° C. |
| P-8: | 2,6-NDCA/NPG (neopentylglycol)/EG (100/70/30) | Tg = 145° C. |
| P-10: | 2,6-NDCA/EG/BP (bisphenol) (100/20/80) | Tg = 130° C. |
| P-11: | PHBA (parahydroxybenzoic acid)/EG/2,6-NDCA (200/100/100) | Tg = 150° C. |

Examples of a Blend of Polyester-polymers

| (the figures in parenthesis indicate a weight ratio) | | |
|---|---|---|
| P-12: | PEN/PET (polyethylene telephthalate) (65/35) | Tg = 96° C. |
| P-13: | PEN/PET (80/20) | Tg = 104° C. |
| P-14: | PAr (polyarylate)/PEN (50/50) | Tg = 142° C. |
| P-15: | PAr/PCT (polycyclohexane dimethanol telephthalate)/PEN (10/10/80) | Tg = 135° C. |
| P-16: | PAr/PC (polycarbonate)/PEN (10/10/80) | Tg = 140° C. |
| P-17: | PEN/PET/PAr (50/25/25) | Tg = 108° C. |

Further, to these polyesters, there can be added a ultraviolet absorbent, for providing storage stability. The ultraviolet absorbent preferably has no absorption in the visible range, and its addition amount is generally from about 0.5 weight % to about 20 weight %, and preferably from about 1 weight % to about 10 weight %, based on the weight of the polymer film. The ultraviolet absorbent cannot sufficiently prevent deterioration due to ultraviolet rays if the amount is too small. Example ultraviolet absorbents, that may be used are benzophenones, such as 2,4-dihydroxybenzophenone, 2-hydroxy-4-methoxybenzophenone, 2-hydroxy-4-n-octoxy-benzophenone, 4-dodecyloxy-2-hydroxybenzophenone, 2,2',4,4'-tetrahydroxybenzophenone and 2,2'-dihydroxy-4,4'-dimethoxybenzophenone; benzotriazoles, such as 2(2'-hydroxy-5-methylphenyl) benzotriazole, 2(2'-hydroxy-3',5'-di-t-butylphenyl) benzotriazole and 2(2'-hydroxy-3'-di-t-butyl-5'-methylphenyl)benzotriazole; and salicylic acids, such as phenyl salicylate and methyl salicylate.

A refractive index of aromatic-series polyesters is as high as 1.6 to 1.7. On the other hand, a refractive index of gelatin, which is a main component of a photosensitive layer coated on the polyester, is from 1.50 to 1.55, which is lower than the above value of 1.6 to 1.7. Therefore, a ray of light incident upon a film edge reflects at the interface between a base and an emulsion layer, and causes so-called light-piping phenomenon (edge-fogging).

Several methods for preventing such light-piping phenomenon are known. For example, inert inorganic grains or dyes are added to the film for the above-described purpose. Of these methods, the addition of dyes is preferred, since this method little increases film haze.

With respect to dyes for use in film dyeing, a color tone is preferably gray-dyeing in terms of general properties of the photosensitive material. Preferably the dye excels in heat resistance at the temperature zone for film production of the polyester film, and it also excels in miscibility to the polyester. The expected results for the dye can be achieved by using commercially marketed dyes for polyesters, such as Diaresin (trade name), manufactured by Mitsubishi Kasei Corp., and Kayaset (trade name), manufactured by Nippon Kayaku Corp., and the dye described in "Kokai-Giho (94-6023, published in Mar. 1, 1994)" alone or in combination, from the above point of view.

The method for film production using these polyesters are described below. Generally, the polymers polymerized according to the above-mentioned method are processed to make pellets of the polyesters, then the pellets are sufficiently dried and are conducted to melt extrusion from a T-die, to produce unstretched films. In that time, preferably the extruded molten polymer is previously passed through a filter. Examples of the filter include a wire net, a sintered wire net, a sintered metal, sand, and a glass fiber. Further, the temperature for melting to form the unstreched film is preferably the melting point (Tm) of the polymer or higher, but 330° C. or below.

After melt extrusion, the resultant polymer is casted onto a cooling drum. Adhesion between the polymer and the drum becomes an important factor for determining the surface flatness of a polymer. For this reason, it is preferred to set an electrode having impressed high voltage between a T-die mouthpiece and the cooling drum, and to generate a charge on an unsolidified polymer, whereby adhesion between the polymer and the cooling drum is improved (hereinafter referred to as "static adhesion"). A blend containing two or more polymers can be made using a conventional multiaxial kneading extruder.

Further, a laminate film may be made by any one of a co-extruding method, an in-line-laminate method, and an off-line-laminate method. According to the co-extruding method of the above-described methods, a film can be made using a feedblock or a multi-manifold. The former has manifolds in accordance with the number of layers, which are linked up with each other at a die line part, whereas the latter is designed to have a linking system in a layer at a pipe part of the die for a single layer. According to the in-line laminate method, a biaxially stretched laminate film is obtained by laminating unstretched or monoaxially stretched film, and then subjecting the laminate film to further stretching (orientation). According to the off-line laminate method, biaxially stretched films are laminated by heat or various adhesives, to make a biaxially stretched laminate film.

The thus obtained unstretched film is subjected to simultaneously or successively biaxially stretching, heat-setting, and heat-annealing, to make a finished film. The number of stretchings in the longitudinal direction and the transverse direction is not limited. Example biaxially stretched film-forming methods that can be used are those described in, for example, JP-A Nos. 109715/1975 and 95374/1975. For example, a finished film can be manufactured by melt-extruding an aromatic polyester at a temperature between a melting point (Tm: °C.) and (Tm+70° C.), to obtain an unstretched film having a specific viscosity of 0.45 to 0.9, and then stretching the said unstretched film in the uniaxial direction (the longitudinal direction or the transverse direction), at a temperature between (Tg−10) and (Tg+70) °C. (wherein the Tg means a glass transition temperature of the aromatic polyester), at a magnification of 2.5 to 5.0-folds, and further stretching the stretched film in a direction perpendicular to the initial stretching direction (i.e., if the first stretching is conducted in the longitudinal direction, the second stretching is done in the transverse direction), at a temperature between Tg°C. and (Tg+70)°C., at a magnification of 2.0 to 4.0-folds. The longitudinal stretching is preferably conducted at 2.3 to 3.7-folds, and more preferably 2.4 to 3.5-folds, while the transverse stretching is preferably conducted at 2.0 to 4.0-folds, more preferably 2.4 to 3.8-folds, and particularly preferably 2.5 to 3.6-folds.

Further, the biaxially oriented film is preferably heat-set at a temperature between (Tg+30)°C. and a melting point (Tm), more preferably from (Tg+40)°C. to (Tm-10)°C., and more preferably from (Tg+60)°C. to (Tm-20)°C. The Tm referred to herein can be measured by means of a scanning-type differential thermal analyzer (DSC). In such a measurement, 10 mg of a sample is heated in a nitrogen stream up to 300° C., at a rate of temperature rise of 20° C./min, and then rapidly cooled to room temperature. After that, the sample is heated again at a rate of temperature rise of 20° C./min. The temperature at the starting point of an endothermic peak that appears at the heating is taken as the Tm.

The thickness of the support for use in the present invention is preferably from 85 μm to 115 μm, more preferably from 85 μm to 100μ, and particularly preferably from 85 μm to 95 μm. When the thickness is too thin, a transverse curl (curl in the width direciton) is apt to be formed, which eventually leads to the generation of scratches and blue (unfocused photograph). On the other hand, when the thickness is too thick, the support is as thick as, or thicker than, the conventional TAC support. This is inapposite to the purpose of reducing the thickness of the support to achieve a compact size.

The present invention sufficiently exhibits its effects when, preferably, the width of the support is 1100 mm or longer, more significantly 1300 mm or longer; and when the width is 1450 mm or longer, particularly significant effects are obtained. Likewise, the present invention sufficiently demonstrates its effects when, preferably, the length of the support is 2200 m or longer, more significantly 2500 m or longer; and when the length is 2900 m or longer; particularly significant effects are obtained.

A surface treatmen is preferably conducted prior to the heat treatment, in order to attain stronger adhesion between the support and a light-sensitive layer.

Preferable example surface treatments are a glow discharge treatment, a corona discharge treatment, an ultraviolet ray treatment, and a flame treatment. Preferred among these are ultraviolet ray treatment and glow discharge treatment, because these treatments are apt to reconcile adhesion between the support and the light-sensitive layer, and to prevent self-adhesion during the heat treatment. Glow discharge treatment is most preferred.

The heat treatment is preferably conducted at a temperature of 95° C. or higher, but below Tg; more preferably 100° C. or higher, but below Tg; and particularly preferably 105° C. or higher, but below Tg.

When polyethyleneterephthalate (PEN) is used, its Tg is 120° C., and a preferred temperature for the heat treatment is from 95° C. to 120° C., more preferably from 100° C. to 120° C., and particularly preferably from 105° C. to 120° C.

The time period for the heat treatment is preferably from 1 hour to 1500 hours, more preferably from 2 hours to 1000 hours, and particularly preferably from 5 hours to 400 hours.

An undercoating layer positioned between the surface-treated support and a photosensitive layer, is explained below. As the undercoating, there can be used a so-called laminate method, which comprises steps of coating on a support a first layer having good adhesiveness with the support (hereinafter referred to as the first undercoating layer), and then coating thereon a second layer having a good adhesiveness with the first undercoating layer and a photosensitive layer (hereinafter referred to as the second undercoating layer). Alternatively, use can be made of a single-layer method, which comprises coating on a support only one layer, which is excellent in adhesiveness between the support and a photosensitive layer.

The undercoating can be performed according to the methods described in HATSUMEI KYOKAI KOKAIGIHO No. 94-6023, pages 18 to 22 (6. Undercoating·Back materials).

Further, the silver halide photosensitive material according to the present invention may have a magnetic recording layer, as described in JP-A No. 59357/1994, in order to record a variety of information. The magnetic recording layer is preferably applied to the back side of the support, by coating or printing. Alternatively, an optically recording space can be applied to the photosensitive material, in order to optically record a variety of information.

Furthermore, a variety of functions are given to the support of the present invention. For example, a lubricant layer can be applied thereto. Known examples of the lubricant are a ployorganosiloxane, as disclosed in JP-B ("JP-B" means a published and examined Japanese Patent Application) No. 292/1978; a higher fatty acid amide, as disclosed in U.S. Pat. No. 4,275,146; a higher fatty acid ester (an ester of a fatty acid having 10 to 24 carbon atoms and an alcohol having 10 to 24 carbon atoms), as disclosed in JP-B No. 33541/1983, GB Patent No. 927,446, JP-A Nos. 126238/1980 and 90633/1983; a metal salt of a higher fatty acid, as disclosed in U.S. Pat. No. 3,933,516; an ester of a straight-chain higher fatty acid and a straight-chain higher alcohol, as disclosed in JP-A No. 50534/1983; and an ester of a higher fatty acid containing a branched alkyl group, and a higher alcohol, as disclosed in WO No. 90108115.8. Application of the lubricant layer can be performed according to the methods described in HATSUMEI KYOKAI KOKAIGIHO No. 94-6023, pages 25 to 28 (7. Lubricants).

Photographic layers of the photosensitive material according to the present invention are described below. A silver halide emulsion layer may be for color or black-and-white photography. Preparation of these emulsion layers can be performed according to the methods described in HATSUMEI KYOKAI KOKAIGIHO No. 94-6023, pages 79 to 83 (16. Photosensitive layers).

The thus obtained films are used as a roll obtained by spooling them in a cartridge. It is preferable to use a spool having a diameter (an outer diameter) of from 5 to 11 mm, more preferably from 6 to 10 mm, and further preferably from 7 to 9 mm. When the spool is smaller than the above-described range, the core set curl becomes too strong and thereby problems are apt to arise in a mini-lab. On the other hand, when the spool is larger than the above range, it is difficult to miniaturize a cartridge.

As is apparent from the results as described in the following Examples, films that are excellent in the emulsion coating (particularly, multi-layer simultaneous coating) while avoiding deterioration of the flatness encountered with the use of heat treatment, can be manufactured by the present invention.

EXAMPLE

The present invention is explained in more detail by means of the following examples, which, however, are not intended to restrict the scope of the present invention. Various values of physical properties and characteristic properties according to the present invention are measured and defined as follows:

(1) A Thickness of the Air Layer Lying Between the Support Layers 1-a. The radius of the roll in advance of heat treatment is measured at five points in the width (the roll is divided into seven equal parts in the direction of the width, and the two end points are neglected, to retain five points). An average value R (mm) of these radii is calculated.

1-b. The radius r (mm) of a core of the roll, the thickness T (μm) of the support, and the length of the support L (m) are measured, and then the thickness A (μm) of the air layer lying between the support layers is calculated according to the following formula:

$$A=\{(\pi/L)\times(R^2-r^2)\}-T$$

(2) Resistance of the Electric Conductive Layer

A sample was cut into a strip of width 1 cm and length 5 cm. After a silver paint was coated on the strip in the direction of the length, the coated strip was subjected to humidity adjustment at conditions of temperature 25° C. and relative humidity 10% RH, for 2 hours, and then resistance of the strip in the direction of the width was investigated while impressing a voltage of 100 V.

(3) Glass Transition Temperature (Tg)

3-a. 10 mg of the sample was set in an aluminum pan in a nitrogen current.

3-b. The Tg was measured by means of a scanning-type differential thermal analyzer (DSC) in a nitrogen current according to the following steps:

i) The temperature was elevated to 300° C. at the rate of 20° C./min (1st run).

ii) The temperature was cooled to room temperature, whereby an amorphous body was formed.

iii) The amorphous body was heated again at the rate of 20° C./min (2nd run).

The Tg is calculated by the arithmetic mean of the temperature at which deviation from the baseline in 2nd run begins, and the temperature at which the new baseline is reached.

Example 1

(1) Manufacture of Film for a Support

The composition of Sample 23 for use in the present invention is PEN/PET=4/1 having a Tg of 104° C., while each of the other samples is composed of PEN having a Tg of 120° C.

PEN (gray dyed): 100 weight parts of polyethylenenaphthalate having a specific viscosity of 0.60, 0.005 weight parts of spherical silica having an average grain size of 0.3 μm and a ratio of the major axis to the minor axis of 1.07, 54 ppm of Dye I-24, and 54 ppm of Dye I-6 as illustrated in following examples of the dye compounds, were dried in the usual way. After these materials were melted at 300° C., the melt was extruded from a T dye to conduct longitudinal stretching at the magnification of 3.3-folds, at 140° C.; transverse stretching at the magnificaiton of 3.3-folds, at 130° C.; and heat-setting at 250° C. for 6 sec, in this order. The transmitted densities of the thus obtained film, measured by means of X-RITE status M (manufactured by X-RITE company), were each 0.07 with respect to B, G, and R.

PEN/PET=4/1 (gray dyed): 80 weight parts of polyethylenenaphthalate having a specific viscosity of 0.60, 20 weight parts of polyethyleneterephthalate having a specific viscosity of 0.60, 0.005 weight parts of spherical silica having an average grain size of 0.3 μm and a ratio of the major axis to the minor axis of 1.07, 46 pm of Dye I-26, and 66 ppm of Dye II-5 as illustrated following examples of the dye compounds, were dried in the usual way. After these materials were melted at 300° C., the melt was extruded from a T dye to conduct longitudinal stretching at the magnification of 3.3-folds, at 140° C.; transverse stretching at the magnificaion of 3.3-folds, at 130° C.; and heat-setting at 250° C. for 6 sec, in this order. The transmitted densities of the thus obtained film, measured by means of X-RITE status M (manufactured by X-RITE Company), were each 0.07 with respect to B, G, and R.

(I-6)

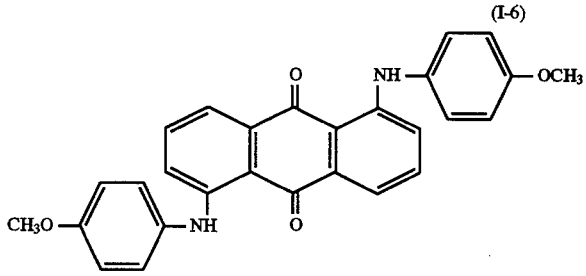

(I-24)

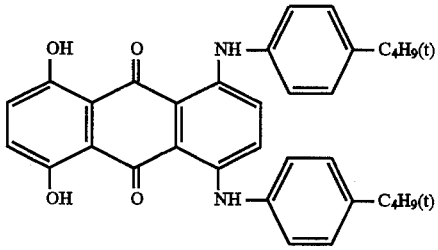

(I-26)

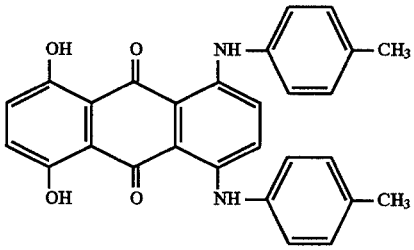

-continued (I-5)

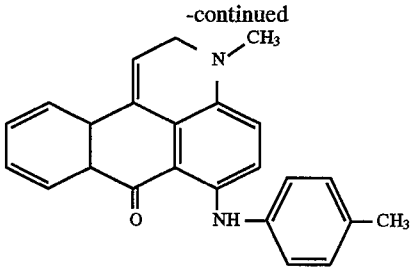

(2) Surface Treatment of Support (Glow Surface Treatment)

Four cylindrical rod electrodes, each of section diameter 2 cm and length 120 cm, were aligned at 10-cm intervals, and were fixed on an insulated plate. This electrode plate was placed in a vacuum tank. The support was conveyed parallel to and at a distance of 15 cm from the front of the electrode, so that the support was subjected to a surface treatment for 2 seconds. A heating roll of 50 cm diameter and equipped with a thermoregulator was set, so that a film contacted a ¾ lap of the roll immediately before the film passed through the electrode. Furthermore, the surface temperature of each of the films was controlled to its Tg−5° C., by contacting the surface of the film with a thermocouple thermometer in the region between the heating roll and the electrode zone.

The pressure in the vacuum container was regulated to 0.2 Torr, while the partial pressure of $H_2O$ in the gas medium was regulated to 75%. The discharge frequency was 30 KHz, and the processing strength was 0.5 kV·A·min/m$^2$. Each supports had the thickness of 90 μm, the width of 1,500 mm, and the length of 3000 m. The support, having been subjected to the treatment, was wound while in contact with a cooling roll of 50 cm diameter and equipped with a thermoregulator, so that the surface temperature of the support would be lowered to 30° C. before its winding.

TABLE 1

| Sample No. | Thickness of air layer* μm | Weight part of fine particles in coating solution | Exponent of volume resistivity | Haze % | Knurling Width mm | Knurling Height μm |
|---|---|---|---|---|---|---|
| Comparative example 1 | 1 | 0 | 18 | 0.5 | 0 | 0 |
| This invention 1 | 5 | 0 | 18 | 0.5 | 0 | 0 |
| This invention 2 | 5 | 0 | 18 | 0.5 | 10 | 10 |
| This invention 3 | 5 | 100 | 7.5 | 1.1 | 10 | 10 |
| Comparative example 2 | 1 | 100 | 7.5 | 1.1 | 10 | 10 |
| This invention 4 | 1.5 | 100 | 7.5 | 1.1 | 10 | 10 |
| This invention 5 | 3 | 100 | 7.5 | 1.1 | 10 | 10 |
| This invention 6 | 6 | 100 | 7.5 | 1.1 | 10 | 10 |
| This invention 7 | 5 | 100 | 7.5 | 1.1 | 0 | 0 |
| This invention 8 | 5 | 100 | 7.5 | 1.1 | 10 | 55 |
| This invention 9 | 5 | 100 | 7.5 | 1.1 | 10 | 0.5 |
| This invention 10 | 5 | 300 | 2.8 | 3.1 | 10 | 10 |
| This invention 11 | 5 | 280 | 3.1 | 2.9 | 10 | 10 |
| This invention 12 | 5 | 70 | 11.5 | 0.9 | 10 | 10 |
| This invention 13 | 5 | 60 | 12.2 | 0.8 | 10 | 10 |
| This invention 14 | 5 | 20 | 13.5 | 0.7 | 10 | 10 |
| This invention 15 | 5 | 10 | 14 | 0.6 | 10 | 10 |
| This invention 16 | 5 | 100 | 17.8 | 1.1 | 10 | 10 |
| This invention 17 | 5 | 100 | 18 | 1.1 | 10 | 10 |
| This invention 18 | 5 | 100 | 17.8 | 1.1 | 10 | 10 |
| This invention 19 | 7.5 | 100 | 7.5 | 1.1 | 10 | 10 |
| This invention 20 | 10 | 100 | 7.5 | 1.1 | 10 | 10 |
| Comparative example 3 | 11 | 100 | 7.5 | 1.1 | 10 | 10 |
| This invention 21 | 5 | 100 | 7.5 | 1.1 | 10 | 10 |
| This invention 22 | 5 | 100 | 7.5 | 1.1 | 10 | 10 |
| This inventioe 23 | 5 | 100 | 7.5 | 1.1 | 10 | 10 |

Note: *Thickness of air layer was controlled according to methods described in JP-A Nos. 28856/1988 and 51155/1993, in addition to changing the conditions for knurling.

| Sample No. | Flatness after heat-treatment: Length of failure in flatness** m | Flatness after heat-treatment: Shear in winding mm | Values of ANSI curl before and after development process: Before | Values of ANSI curl before and after development process: After |
|---|---|---|---|---|
| Comparative example 1 | 1500 | 0 | 128 | 55 |
| This invention 1 | 530 | 1 | 127 | 54 |
| This invention 2 | 270 | 0 | 128 | 55 |
| This invention 3 | 21 | 0 | 129 | 56 |
| Comparative example 2 | 800 | 0 | 130 | 54 |
| This invention 4 | 15 | 0 | 128 | 55 |
| This invention 5 | 10 | 0 | 130 | 55 |
| This invention 6 | 8 | 1 | 128 | 56 |
| This invention 7 | 120 | 0 | 126 | 55 |
| This invention 8 | 5 | 8 | 128 | 56 |
| This invention 9 | 110 | 0 | 129 | 58 |
| This invention 10 | 5 | 0 | 128 | 57 |

TABLE 1-continued

| | | | | |
|---|---|---|---|---|
| This invention 11 | 5 | 0 | 128 | 24 |
| This invention 12 | 10 | 0 | 127 | 57 |
| This invention 13 | 15 | 0 | 126 | 55 |
| This invention 14 | 28 | 0 | 126 | 56 |
| This invention 15 | 45 | 0 | 128 | 58 |
| This invention 16 | 20 | 0 | 127 | 55 |
| This invention 17 | 22 | 0 | 126 | 57 |
| This invention 18 | 28 | 0 | 128 | 56 |
| This invention 19 | 7 | 1 | 127 | 53 |
| This invention 20 | 8 | 3 | 126 | 52 |
| Comparative example 3 | 7 | 25 | 128 | 55 |
| This invention 21 | 8 | 1 | 165 | 80 |
| This invention 22 | 7 | 0 | 135 | 60 |
| This inventioe 23 | 9 | 1 | 132 | 59 |

Note: **Length of failure in flatness means length (m) of portion failure in flatness including portion in which cracks, uneveness in coating was observed.

Each of Sample 1 of comparison and samples 1 to 3 of the present invention had not been subjected to a glow discharge treatment.

(3) Coating of First Backing Layer

To a support whose both surfaces had been subjected to a surface treatment, a coating solution for a backing layer having the composition described below, was coated on the surface at the side of a photographic emulsion to be coated (i.e., the surface at the opposite side of a surface that was contacting a casting drum at a production of the film), by the use of a wire bar at the rate of 5 ml/m$^2$, and then the coated support was dried at 115° C. for 2 min. After that, the coated support was rolled around a reel.

| Formulaiton | |
|---|---|
| Gelatin | 1.0 weight part |
| Distilled water | 1.0 weight part |
| Acetic acid | 1.0 weight part |
| Methanol | 50.0 weight parts |
| Ethylene dichloride | 50.0 weight parts |
| P-Chlorophenol | 4.0 weight parts |

(4) Coating of Second Backing Layer (Electrically Conductive Layer)

The term "part" hereinafter referred to means a part by weight.

In 3,000 parts of ethanol, were dissolved 230 parts of stannic chloride hydrate and 23 parts of antimony trichloride, to prepare a uniform solution. To the solution was added, dropwise, a 1N sodium hydroxide aqueous solution, to adjust to a pH of 3, thereby to co-precipitate colloidal stannic oxide and antimony oxide. The thus obtained co-precipitate was allowed to stand at 50° C. for 24 hours, to obtain a reddish brown colloidal precipitate, which was collected by centrifugation.

The solid was washed three times with water by centrifugation, to remove excess ions.

In 1500 parts of water, was re-dispersed 200 parts of the colloidal precipitate that had had excess ions removed from it, and the dispersion was atomized into a calcining furnace heated at 500° C., to obtain blue-tinted fine particles of stannic oxide-antimony oxide complex having an average particle size of 0.005 μm and resistivity of 25 Ω·cm.

A mixture of 40 parts of the resulting fine particles and 60 parts of water was adjusted to pH 7.0, coarsely dispersed in a stirrer, and finely dispersed in a horizontal sand mill (Dynomill, manufactured by Willy A. Backfen AG) for a retention time of 30 minutes, to prepare a dispersion in which primary particles were partly condensed to form a secondary condensation having a particle size of 0.05 μm.

A coating solution having the formulation shown below was coated on the support to a dry thickness of 0.3 μm, and the support was dried at 110° C. for 30 seconds.

| Formulation | |
|---|---|
| Dispersion of electrically conductive fine particles above prepared | Added amount is described in Table 1 |
| Gelatin (lime-treated gelatin containing $Ca^{++}$ of 100 ppm) | 10 parts |
| Water | 270 parts |
| Methanol | 600 parts |
| Resorcin | 20 parts |
| I-13 as described in JP-B No. 27099/1991) | 0.1 part |

In Sample 16 of the present invention, a 40% by weight aqueous solution of alumina (diameter of 0.15 μm); in Sample 17 of the present invention, a 40% by weight aqueous solution of spherical silica (diameter of 0.15 μm); and in Sample 18 of the present invention, a 40% by weight aqueous solution of calcium carbonate (diameter of 0.15 μm) was added, respectively, in place of the above dispersion of electrically conductive fine particles.

(5) Provision of Rollettes

Rollettes, each of width 10 mm and height 10 μm, were formed on both width ends of the support, extending the total length thereof. At this time, the temperature of the press mold (a roll having a pair of convexity and concavity: the convexity and the concavity are formed by a pitch of 0.5 mm in length and 0.5 mm in width) was elevated to 150° C., and the pressure was set at 2 kg. Knurling conditions other than the above are shown in Table 1.

(6) Heat Treatment of the Support

The support was wound round a reel at room temperature according to the following conditions:

Reel: a hollow aluminum reel of diameter 300 mm and length 1800 mm

Winding tension: initial tension, 30 kg/m; final tension, 10 kg/m

The roll of the support was subjected to heat treatment in a thermostat under the conditions described below. The winding of the support round the reel was always conducted so that the surface on which the backing layer was coated would be on the inside of the roll.

Heat treatment was respectively conducted at 90° C. for 30 hours for Sample 21 of the present invention, at 95° C.

for 30 hours for Sample 22 of the present invention, and at 99° C. for 24 hours for Sample 23 of the present invention, whereas it was conducted at 110° C. and for 30 hours for the other samples.

(7) Coating of Subbing Layer (Side to be Coated with a Photographic Emulsion Layer)

A solution for the subbing layer having the following formulation was coated on the support at a spread of 10 ml/m$^2$ by means of a wire bar. After drying it at a temperature of 115° C. for 2 minutes, the film was wound.

| Formulation | |
|---|---|
| Gelatin | 10.0 parts |
| Water | 24.0 parts |
| Methanol | 961.0 parts |
| Salicylic acid | 3.0 parts |
| Polyamide-epichlorohydrine resin as described in Synthetic Example 1 of JP-A No. 3619/1976 | 0.5 parts |
| Nonionic surfactant (Nonionic surfactant I-13 as described in JP-B No. 27099/1991) | 0.1 part |

On the support surface of the subbing layer, the below-mentioned photographic layers were coated.

(8) Coating of Third Backing Layer

To the surface-treated support having coated thereon the subbing layer, and the first and second backing layer, was further coated a solution having the following formulation, to a dry thickness of 1.2 μm, and the support was dried at a temperature of 115° C.

| Formulation | |
|---|---|
| Diacetylcellulose | 100 parts |
| Trimethylolpropane-3-toluenediisocyanate | 25 parts |
| Methylethylketone | 1050 parts |
| Cyclohexane | 1050 parts |

(9) Coating of Forth Backing Layer (Lubricant Layer)

(9-1) Preparation of First Solution for Lubricant Layer

The first solution, having the following formulation and dissolved by heating at 90° C., was added to the second solution, and the mixture was dispersed by means of a high-pressure homogenizer, to obtain a lubricant undiluted dispersion.

| First Solution | | |
|---|---|---|
| Lubricant-1 | $C_6H_{13}CH(OH)(CH_2)_{10}COOC_{40}H_{61}$ | 0.7 g |
| Lubricant-2 | $n\text{-}C_{17}H_{35}COOC_{40}H_{81-n}$ | 1.1 g |
| Xylene | | 2.5 g |

(9-2) Preparation of Second Solution for Lubricant Layer

To the first solution for the lubricant layer, was added the following binders and solvents, to prepare a coating solution.

| | |
|---|---|
| Propyleneglycol monomethyl ether | 34.0 g |
| Diacetylcellulose | 3.0 g |
| Acetone | 600.0 g |
| Cyclohexane | 350.0 g |

(9-3) Coating of Lubricant Layer

With respect to all the levels shown in Table 1, the above-described coating solution was coated on the outermost backing layer, by means of a wire bar coater, in a coating amount of 10 ml/m$^2$.

(10) Preparation of Light-Sensitive Material

Layers described in Example 1 in JP-A No. 308664/1994 were multi-coated on the thus prepared support, to prepare a multi-layer color negative light-sensitive material.

(11) Evaluation (11-1) Haze

Haze of the backing layer instantly after the coating of an antistatic layer thereon was measured according to the method described in JP-A No. 24446/1989. The level of haze that dose not cause any serious problem in practical use is below 3%.

(11-2) Shear in Winding During Handling

A roll that had not been subjected to heat treatment was evaluated in a model test according to the following method:

A push car carrying thereon a roll is run at a speed of 10 km per hour. This is perpendicularly struck into a concrete wall coated with a gum of thickness 10 mm. The shear in the ends of the roll (the difference between the most pushed-out portion and the most pushed- back portion) that occurred at this time is measured.

(11-3) Flatness after Heat Treatment

The support that was subjected to heat treatment was evaluated from the following points of view:

Flatness: The length of defect (a portion wherein an appearance of rumples and unevenness can be examined with the naked eye) in the total length was recorded.

Shear in winding: The difference between the most pushed-out portion and the most pushed-back portion at the ends of the roll was measured.

(11-4) Evaluation of Core Set Curl and Passability Through Compact Labs

Similarly, measurement and evaluation to the samples after hardening the films were made according to the below-mentioned manner:

Core Set

Sample film: Width 35 mm, Length 1.5 m

Regulation of humidity: 25° C., 60% RH overnight

Core set: The sample film was rolled onto a spur having a diameter of 7 mm, with the film's side having coated on it a light-sensitive layer being inward, and the resulting rolled film was set in a sealed container. After that, the film was heated at 80° C., 2 hours (a condition simulating film that is left in a car in the summer season).

Cooling to room temperature: a film is allowed to stand in a room at 25° C. overnight.

(a) Evaluation of Core Set Curl before Development

The sample thus cooled to room temperature was taken out of the sealed container, to release the core set. Immediately after that, the curl at the most internal lap of the film was measured according to a test method A of ANSI/ASC PH1.29-1985.

(b) Evaluation of Passability through Compact Labs (Mini-Labs)

A film having a strong core set curl is apt to cause a problem during a developing process with a compact lab in most cases. For this reason, the following evaluation was conducted.

Immediately after the measurement of the core set curl before development, color development was conducted using a compact lab processor (Compact Lab FP-550B, CN-16Q developing solution, trade-names, manufactured by Fuji Photo Film Co., Ltd.). A compact lab processing was carried out by fixing an end of the film with its side having been curled outward, to a leader according to a conventional method.

The sample films having been subjected to the compact lab processing were evaluated by visual observation, marking the following standpoints:

cracks: a strongly curled sample cannot pass through a nip roll for a drive in the compact lab, and is struck, so that cracks occur at the end of the sample opposite to the leader.

Unevenness: a strongly curled sample passes through in a compact lab in a rolled form. Therefore a sufficient amount of a developing solution cannot be supplied to the inside of the curled sample, which results in an "unevenness" of the development. The samples were evaluated by visual observation.

(c) Evaluation of Core Set Curl after Development

Immediately after development processing with a compact lab processor, a curl at the side of the most internal lap was measured according to the above-described method.

(12) Results

As is apparent from the results shown in Table 1, a base that is excellent in recovery of the curl without deterioration of the flatness can be manufactured by the heat treatment of a bulk roll at a temperature between 50° C. and Tg of the polyester to be used, according to the present invention.

Example 2

In place of the glow discharge treatment as employed in Example 1, 300 mJ/cm$^2$ of ultraviolet ray (UV) treatment was conducted, by the use of the high-voltage mercury lamp, to both the surface and the back surface of the support, while maintaining a distance of 30 cm between the mercury lamp and the support. Other procedures up to the emulsion coating were performed in the same way as in Example 1, except that a coating solution for a subbing layer, having the composition as described below, was coated on the support, by the use of a wire bar, at an amount of 10 ml/m$^2$, and then the coated support was dried at 115° C. for 2 minutes, and wound.

| | |
|---|---|
| Gelatin | 10.0 weight parts |
| Water | 10.0 weight parts |
| Methanol | 500.0 weight parts |
| Acetic acid | 10.0 weight parts |
| Ethylene dichloride | 500.0 weight parts |
| P-Chlorophenol | 40.0 weight parts |

As a result, the similar results as in Example 1 were obtained.

Example 3

In place of the surface treatment employed in Example 2, a flame treatment was conducted to both the surface and the back surface of the support, by the use of a flame treatment apparatus manufactured by Kasuga Denki Co., Ltd. The amounts of each level of flame heat applied at this time are shown below. The flame treatment was performed, in each level, at the ratio of propane gas to air=1/17 and the treatment strength of 20 kcal/m$^2$, while keeping a distance between the inner flame and the support at 1 cm, and contacting the support on a cooling roll provided with a flow of water through the roll at 10° C. Other procedures up to the coating of the emulsion were performed in the same way as in Example 2. As a result, the similar results as in Examples 1 and 2 were obtained.

Example 4

In place of the surface treatment employed in Example 2, a corona discharge treatment was conducted to both surfaces of the support, by the use of a solid-state corona discharge device, Model 6 KV, manufactured by Piller Company, at the condition of 0.375 kV·A·min/m$^2$. Other procedures up to the coating of the emulsion were repeated in the same way as in Example 2, to prepare samples. As a result of evaluation of these samples, the similar results as in Example 1 were obtained.

Having described our invention as related to the present embodiments, it is our intention that the invention not be limited by any of the details of the description, unless otherwise specified, but rather be construed broadly within its spirit and scope as set out in the accompanying claims.

What I claim is:

1. A process for heat treatment of a photographic polyester film support, comprising steps of winding a biaxially oriented polyester film into a roll so that the thickness of a gas layer lying between the film layers continually becomes 1.5 μm to 10 μm, and then subjecting the roll of the polyester film to heat treatment at a temperature between 50° C. and the glass transition temperature of the polyester, wherein the width of the polyester film support is 1100 mm or longer and the polyester film support is subjected to knurling.

2. The process as claimed in claim 1, wherein at least one layer containing fine particles is coated on at least one surface of the polyester film support.

3. The process as claimed in claim 2, wherein the coated layer containing the fine particles is an electrically conductive layer having resistance of $10^3\Omega$ or higher, but $10^{12}\Omega$ or below.

4. The process as claimed in claim 3, wherein the electrically conductive layer comprises Zn, Ti, Sn, Al, In, Si, Mg, Ba, Mo, W, or V as a main ingredient, and it has a volume resistance of no greater than $10^7\Omega$cm.

5. The process as claimed in claim 1, wherein the polyester of the support contains 30 mol % or more of 2,6-naphthalanedicarboxylic acid units in the total dicarboxylic acid units.

6. The process as claimed in claim 1, wherein the thickness of the polyester film support is from 85 to 100 μm.

7. The process as claimed in claim 1, wherein the thickness of the polyester film knurled portion is thicker by 5 to 50 μm than the average thickness of the polyester film support.

8. The process as claimed in claim 7, wherein the thickness of the knurled portion is 3 to 25 μm.

9. The process as claimed in claim 1, wherein the polyester film support is conducted by at least one of surface treatments selected from a group consisting of glow discharge treatment, ultraviolet treatment, flame treatment, and corona discharge treatment.

10. The process as claimed in claim 1, wherein the polyester film support substantially comprises polyethylene-2,6-naphthalate.

11. The process as claimed in claim 1, wherein the roll of the polyester film is subjected to heat treatment at a temperature between 95° C. and 120° C.

12. The process as claimed in claim 1, wherein the polyester film is wound into a roll by winding tension of from 3 to 75 kg/m.

13. The process as claimed in claim 1, wherein thickness of the gas layer is from 2.5 to 5 μm.

* * * * *